United States Patent [19]

De Donato

[11] Patent Number: 4,608,847

[45] Date of Patent: Sep. 2, 1986

[54] TOOL FOR FORMING A SCROLL

[76] Inventor: Victor De Donato, 30 Lemoyne Ave., Pittsburgh, Pa. 15228

[21] Appl. No.: 729,981

[22] Filed: May 2, 1985

[51] Int. Cl.[4] ..... B21C 47/00

[52] U.S. Cl. ..... 72/148

[58] Field of Search ..... 29/173; 72/146, 147, 72/148, 149

[56] References Cited

U.S. PATENT DOCUMENTS

| | | | |
|---|---|---|---|
| 533,513 | 2/1895 | Weed | 72/147 |
| 797,287 | 8/1905 | Jewett | 72/147 |
| 823,765 | 6/1906 | Conklin | 72/147 X |
| 924,907 | 6/1909 | Jones | 72/149 |
| 1,731,087 | 10/1929 | Zatti | 72/149 X |
| 2,822,023 | 2/1958 | Ahern | 72/149 X |
| 3,020,949 | 2/1962 | Garcia | 72/147 X |

FOREIGN PATENT DOCUMENTS

| | | | |
|---|---|---|---|
| 1497561 | 10/1967 | France | 72/148 |
| 2128149 | 10/1972 | France | 72/147 |

*Primary Examiner*—E. Michael Combs

*Attorney, Agent, or Firm*—William J. Ruano

[57] ABSTRACT

A tool and method for forming a scrolled end of a metallic bar or strip. The tool comprises a pair of horizontal plates having a scroll forming bent end, an eccentric having a vertical pivot extending through said plates, and an upper bolt head with a socket to enable insertion of a tool or wrench for turning or holding the eccentric. A depending sleeve with internal serrations is provided for driving said tool by a motor. A guide roll extending upwardly from a work table on which said tool is mounted is in spaced relationship to serve as a stop as the tool is rotated by said motor in a counterclockwise direction to form the scroll.

The method comprises inserting the end of a metallic bar into the concave opening or slot of said scroll forming bent end and applying a wrench to the socket so as to turn the eccentric sufficiently to grip the inserted end of the strip, and then rotating by a drive motor, a dependent sleeve so that the assembly will rotate in a counterclockwise direction to form a scroll on the end of said bar.

3 Claims, 4 Drawing Figures

TOOL FOR FORMING A SCROLL

This invention relates to a tool and method for forming a scroll on the end of a metal strip or bar, normally for ornamental purposes; such as, for portions of a fence, stair banister, gate, and the like.

An outstanding disadvantage of conventional methods and apparatus for making such scrolls is that they involve very complicated and expensive machinery which also limits the thickness of bars or strips to be bent into a scroll.

An object of the present invention is a provide a novel tool and method for forming a scroll on the end of a metal strip or bar which will overcome the disadvantages of present methods and tools.

Other objects and advantages of the invention will become more apparent from a study of the following description taken with the accompanying drawing wherein.

Figure 1:
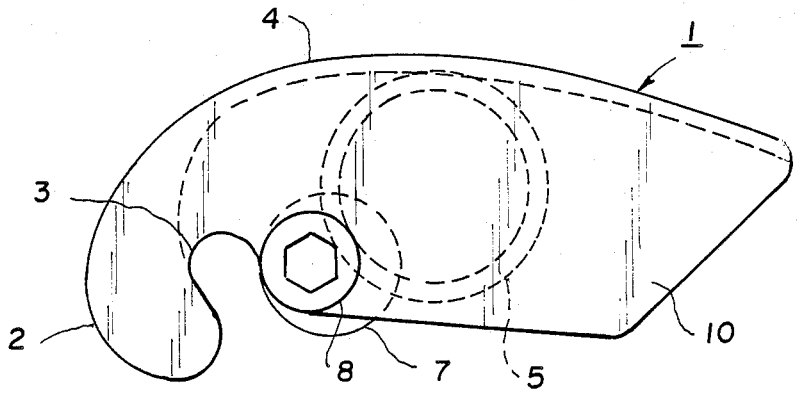
FIG. 1 is a top view of a tool embodying the present invention.
Figure 2:
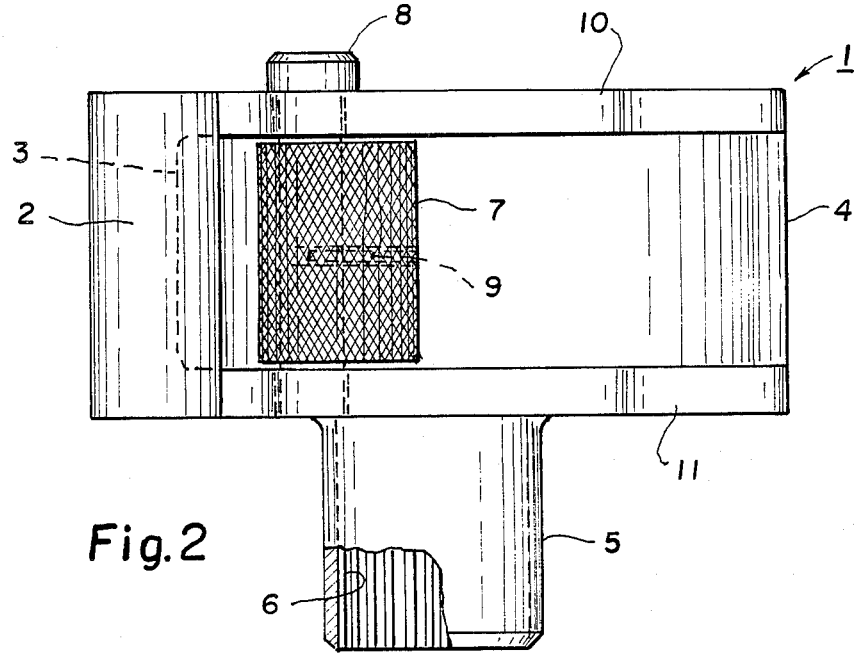
FIG. 2 is a front or elevation view thereof showing the portion of a dependent drive sleeve cut away to illustrate the serrated interior thereof.
Figure 3:
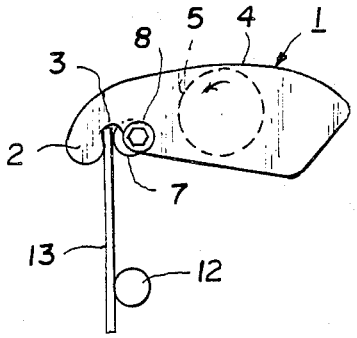
FIG. 3 is a top or plan view of the tool of FIGS. 1 and 2 shown mounted on a table from which emerges a guide roller.

Referring more particularly to FIGS. 1 and 2 of the drawing, numeral 1 generally denotes a tool for forming a scroll on the end of a metallic bar or strip, which has an end 2 which is bent inwardly so as to form a slot 3 into which the end of a bar or strip 13 of metal may be inserted (FIG. 3). The tool is curved at 4 into the shape of a scroll and has a depending sleeve 5 having internal vertical serrations 6 so as to be driven by a correspondingly serrated shaft of a driving motor (not shown). The tool 1 is provided with an eccentric sleeve 7 which is serrated and which is mounted on a vertical pivot extending through top and bottom plates 10 and 11, respectively, of the tool. The eccentric 7 is rigidly mounted on said pivot by key 9 and mya be held in place or turned by inserting the end of a wrench into the socket of the bolt head 8.

Figure 4:
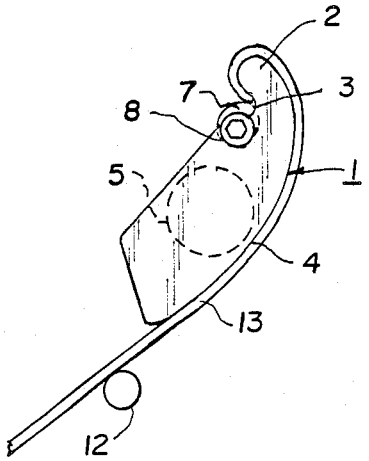
FIG. 4 is a view similar to FIG. 3 showing the bent or scrolled rod after the tool has been driven in a counterclockwise direction.

In operation, and referring to FIGS. 3 and 4, the tool is mounted on a work table (not shown) into an opening of which a sleeve 5 depends and is driven by a correspondingly serrated drive shaft of a motor (not shown) so as to drive the tool in a counterclockwise direction from the initial position shown in FIG. 3. After the end of a metal strip 13 is inserted in the slot or opening 3, the wrench is turned so as to turn eccentric 7 into wedging relationship with the end of strip 13. The wrench is turned clockwise to form a tight fit with the aid of the end portion 2 while the other end of the strip 13 is held against guide roller 12. Upon driving the tool in a counterclockwise direction, the strip 13 will be ultimately bent in the manner shown in FIG. 4 so as to form a scrolled end portion or the strip.

It will be noted that wrench inserted in the socket of the bolt head 8 need to held tightly only initially. After the tool is driven slightly counterclockwise, it need no longer be held since the bent portion of the rod aided by the guide roller 12 will force the strip to firmly hug the outer surface of 2 and 4 of the tool so as to finally form the scroll shown in FIG. 4. The scrolled strip 13 may then be removed.

Thus it will be seen that I have provided a relatively simple and inexpensive tool that can be readily made by any machinist and which can be easily mounted on an existing work bench so as to form scrolls o the end portions of bars or strips of varying thicknesses simply by turning the eccentric to a lesser or greater degree when gripping the end thereof inside the tool.

While I have illustrated and described a single specific embodiment of my invention, it will be understood that this is by way of illustration only and that various changes and modifications may be contemplated in my invention within the scope of the following claims.

I claim:

1. A tool for forming a scroll on the end protion of a metallic bar, said tool comprising a pair of spaced horizontal metal plates integral with a plate which is an outer surface curved on in the form of a scroll and a side opposite said outer surface is open and provided with a slot in the upper horizontal plate into which the end of a bar to be bent into a scroll is axially inserted, an eccentric sleeve vertically and rigidly mounted on a pivot which extends vertically through both said horizontal plates, terminating in an upper bolt head, said eccentric sleeve being substantially enclosed by said horizontal plates and positioned so as to progressively narrow the entrance of said slot when turned by said bolt head, an integral depending coupling element extending from the lower most horizontal plate for coupling to a driving motor, whereby upon turning and holding said extended bolt head by a wrench, it will progressively wedge the end portion of the bar within said tool and whereby upon driving said tool in a counterclockwise direction while supporting the free end of the strip against a guide roll, the strip end will be bent into the form of a scroll.

2. A tool as recited in claim 1 wherein the outer surface of said eccentric sleeve is serrated to enable a firmer grip with said end portion of said bar.

3. A tool as recited in claim 1 in combination with a work table on which said tool is supported, and a guide roller mounted on said table in spaced relationship opposite said slot, whereby it will serve as a stop for said strip as said tool is rotated counterclockwise by said driving motor and force said strip to assume the outside curvature of said plates.

* * * * *